US011352857B2

(12) United States Patent
Stokke et al.

(10) Patent No.: US 11,352,857 B2
(45) Date of Patent: Jun. 7, 2022

(54) SUBSEA WELL INSTALLATION

(71) Applicant: EQUINOR ENERGY AS, Stavanger (NO)

(72) Inventors: Ragnar Stokke, Oslo (NO); Kjell Einar Ellingsen, Tananger (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 17/041,159

(22) PCT Filed: Mar. 25, 2019

(86) PCT No.: PCT/NO2019/050062
§ 371 (c)(1),
(2) Date: Sep. 24, 2020

(87) PCT Pub. No.: WO2019/190329
PCT Pub. Date: Oct. 3, 2019

(65) Prior Publication Data

US 2021/0010352 A1 Jan. 14, 2021

(30) Foreign Application Priority Data

Mar. 26, 2018 (GB) ..... 1804819

(51) Int. Cl.
*E21B 34/06* (2006.01)
*E21B 43/013* (2006.01)
*E21B 43/017* (2006.01)

(52) U.S. Cl.
CPC ..... *E21B 43/013* (2013.01); *E21B 34/066* (2013.01); *E21B 43/017* (2013.01)

(58) Field of Classification Search
CPC ..... E21B 34/066; E21B 43/013; E21B 43/017
See application file for complete search history.

(56) References Cited

U.S. PATENT DOCUMENTS 4,615,646 A 10/1986 Langner
4,629,003 A 12/1986 Baugh
(Continued)

FOREIGN PATENT DOCUMENTS

CN 1228826 9/1999
CN 202100243 1/2012
(Continued)

OTHER PUBLICATIONS

International Search Report dated May 10, 2019 in International (PCT) Application No. PCT/NO2019/050062.
(Continued)

*Primary Examiner* — Matthew R Buck
(74) *Attorney, Agent, or Firm* — Wenderoth, Lind & Ponack, L.L.P.

(57) ABSTRACT

A subsea well installation is provided, comprising a first pipeline comprising a first valve arrangement and a second pipeline comprising a second valve arrangement. The first valve arrangement is connected to a first subsea well and the second valve arrangement is connected to a second subsea well. The first valve arrangement is connected to the second valve arrangement. The installation is arranged such that fluid can be routed from the first well to any of the first pipeline and second pipeline. Each valve arrangement may comprise three two-way ball valves. Also provided is a method of installing the subsea well installation and a method of operating the subsea well installation.

17 Claims, 6 Drawing Sheets

(56) References Cited

U.S. PATENT DOCUMENTS

| | | | | |
|---|---|---|---|---|
| 6,142,708 | A | 11/2000 | Tarlton et al. | |
| 6,148,921 | A | 11/2000 | Valla et al. | |
| 6,435,771 | B1 | 8/2002 | Baugh | |
| 6,481,504 | B1 | 11/2002 | Gatherar | |
| 7,093,661 | B2 * | 8/2006 | Olsen | E21B 37/00 166/357 |
| 7,793,724 | B2 * | 9/2010 | Daniel | E21B 43/017 166/366 |
| 2008/0014026 | A1 | 1/2008 | Routeau et al. | |
| 2008/0135256 | A1 | 6/2008 | Daniel et al. | |
| 2009/0288836 | A1 | 11/2009 | Goodall | |
| 2012/0125688 | A1 | 5/2012 | Noble et al. | |
| 2013/0277060 | A1 | 10/2013 | Critsinelis et al. | |
| 2019/0120020 | A1 | 4/2019 | Rageot et al. | |
| 2020/0332628 | A1 * | 10/2020 | de Araujo Bernardo | E21B 41/00 |
| 2021/0079763 | A1 * | 3/2021 | Ali | F16L 1/16 |

FOREIGN PATENT DOCUMENTS

| | | | | |
|---|---|---|---|---|
| CN | 102498258 | | 6/2012 | |
| CN | 103711460 | | 4/2014 | |
| EP | 1 266 123 | | 11/2006 | |
| GB | 1071155 | | 6/1967 | |
| GB | 1 243 062 | | 8/1971 | |
| GB | 2549102 | | 10/2017 | |
| GB | 2564138 | | 1/2019 | |
| WO | 91/05938 | | 5/1991 | |
| WO | WO-2011110950 | A2 * | 9/2011 | F16L 1/18 |
| WO | 2013/037002 | | 3/2013 | |
| WO | 2018/045357 | | 3/2018 | |
| WO | 2018/111120 | | 6/2018 | |
| WO | WO-2019008435 | A1 * | 1/2019 | F16L 41/03 |

OTHER PUBLICATIONS

Written Opinion dated May 10, 2019 in International (PCT) Application No. PCT/NO2019/050062.

GB Search Report dated Jul. 31, 2018 in corresponding GB Application No. 1804819.9.

* cited by examiner

SUBSEA WELL INSTALLATION

The present invention relates to subsea well installations, in particular installations in which pipelines are connected with wells using valve arrangements. The invention further relates to a method of installing a subsea well installation.

In existing subsea well installations, one or more wells (i.e. hydrocarbon wells), having a production system such as an xmas tree, may be connected to a manifold, which distributes fluid (e.g. hydrocarbons) extracted from the wells to a pipeline. In a traditional arrangement, currently used in the North Sea for example, the wells and manifold may all be arranged on the same supporting frame. An alternative arrangement particularly suited for deepwater developments is a cluster manifold system. In a cluster manifold system, multiple wells are each connected to a manifold, known as a cluster manifold, with a rigid or flexible well spool or jumper. The cluster manifold, which can be a significant 50-ton structure, comprises a "slot" for receiving fluid from a well, thus a four-slot cluster manifold can receive fluids from four separate wells. In some cases control cables are also provided between each well and the manifold; or, a separate subsea distribution unit may be provided which distributes electrical and hydraulic power to the xmas trees and manifolds. The manifold is then connected to a pipeline (a production line) typically by a traditional spool (flexible or rigid). The connection point on the pipeline may be a pipeline end termination or pipeline end manifold, and a connection point is also provided on the manifold. Thus, fluids extracted from each well are provided to the manifold via the spool or jumper, and the manifold then provides the fluid to the production line (pipeline). The wells are typically located in an area of within 50 metres of the cluster manifold.

In some situations it may be desirable to connect a cluster manifold to more than one pipeline. Different wells will produce different levels of hydrocarbons, and it may be the case that one pipeline cannot handle the quantity produced. If the cluster manifold is connected to more than one, typically two, pipelines, then production can be balanced by distributing the produced hydrocarbons between the two pipelines.

The installation of such a cluster manifold subsea well installation will typically comprise the steps of installing the manifold, installing the wells (having xmas trees) and installing a spool between the manifold and the pipeline. Typically the spool will be a 12 inch rigid spool, the installation of which requires a lifting crane on a large vessel. The distance between the manifold and each well is measured, and spools or jumpers are then manufactured to the correct length for connecting the manifold with each well. This process typically takes five to seven weeks. Not only is this a costly process in itself, but the commencement of production from the wells is delayed whilst the spools/jumpers are manufactured and installed thereby delaying realisation of profit from the contents of the wells.

According to a first aspect, the present invention provides a subsea well installation, the installation comprising a first pipeline comprising a first valve arrangement and a second pipeline comprising a second valve arrangement, wherein the first valve arrangement is connected to a first subsea well, wherein the second valve arrangement is connected to a second subsea well, wherein the first valve arrangement is connected to the second valve arrangement and wherein the installation is arranged such that fluid can be routed from the first well to any of the first pipeline and second pipeline.

It will be appreciated that where there is discussion of fluids with regards to the present invention, this may refer to the fluid produced by the wells, e.g. extracted from the formation. These may be fluids from a subsea formation, such as a reservoir. The fluid may be referred to as production fluid. The fluid may for example comprise gas, oil and/or water and may be hydrocarbons. It will also be appreciated that where the connection of valve arrangements and wells is described, this means that a fluidic connection is provided. Thus for example the first valve arrangement being connected to the first well means that the first valve arrangement is fluidically connected to the first well such that fluid can be passed therebetween.

Generally, the first valve arrangement is deployed inline of the first pipeline and the second valve arrangement is deployed inline of the second pipeline. Since the valve arrangements are inline of the pipelines, and they provide the functionality provided by existing manifolds (e.g. cluster manifolds) they may each be considered as forming a manifold inline of the pipeline. Or, that the pipelines each comprise an inline manifold in the form of a valve arrangement. In this way the valve arrangements may be considered 'inline' as they provide the function of an inline manifold. The valve arrangements may be considered as 'inline' because the respective pipelines each comprises the valve.

Each pipeline comprising the respective valve arrangement may mean that the valve arrangement is part of the pipeline, e.g. integrated into the pipeline. This may be achieved by the valve arrangement being directly connected to the pipeline and/or installed thereon. Thus, for example, the first valve arrangement may be integrated into the first pipeline and the second valve arrangement may integrated into the second pipeline.

This may mean that the valve arrangement can be installed together with the respective pipeline.

The feature of the first pipeline comprising the first valve arrangement most preferably comprises the first valve arrangement being deployed (for example installed) in a pipeline section connected inline of the first pipeline. In other words, the first pipeline preferably comprises a first valve arrangement deployed (for example installed) in a pipeline section of the first pipeline. In other words, the first pipeline preferably comprises a pipeline section comprising the first valve arrangement wherein the pipeline section is connected inline of the first pipeline. For example, the first pipeline preferably comprises a pipeline section having the first valve arrangement deployed (for example installed) therein, wherein the pipeline section is connected inline of the first pipeline.

It will be appreciated that by the pipeline section being connected "inline" of the pipeline means that it is connected "in the line of" the pipeline, to form a continuous conduit with the pipeline. The pipeline section may be connected in between two parts of the pipeline. Or, the pipeline section may be connected at the end of a pipeline.

Similarly, the second pipeline preferably comprises a pipeline section comprising the second valve arrangement, wherein the pipeline section is connected inline of the second pipeline. For example, the second pipeline preferably comprises a pipeline section having the second valve arrangement deployed (for example installed) therein, wherein the pipeline section is connected inline of the second pipeline.

Thus each valve arrangement may be part of a pipeline section that in turn is part of the pipeline.

Each pipeline may comprise at least one pipeline section that comprises a valve arrangement.

The pipelines and/or pipeline sections may be for and/or in line with a pipeline for transporting fluid (e.g. production fluid) from a subsea well to a processing facility, storage facility and/or topside location. The pipeline may be the main transport pipeline of fluids away from the wells. For example, it may be the pipeline for transporting well fluids (e.g. crude oil and natural gas) from the field or gathering system to the refinery.

The pipeline and/or pipeline section may be at least 5 m long, at 10 m or at least 50 m.

The pipeline sections may also be called header pipes or header pipe joints.

The pipeline sections may for example be 30 foot (9.1 m) sections of pipe.

Thus, where it is described that a pipeline comprises a valve arrangement, it will be appreciated that this includes a pipeline comprising a pipeline section which comprises a valve arrangement, the pipeline section being connected inline of the pipeline.

By the pipeline section comprising a valve arrangement it may be meant that the valve system is directly installed into the pipeline section such that it is integrated with (i.e. part of) the pipeline structure, and not connected to it through, for example, pipeline spools.

By providing the valve arrangements in pipeline sections, the valve arrangements can be installed in the pipeline sections on-shore e.g. by welding, and also tested on-shore. The pipeline sections having the valves installed therein can then be provided to the laying vessel, and connected inline of the pipelines on the laying vessel prior to lowering subsea. The pipeline sections will typically be welded inline of the pipelines.

In other embodiments, the first pipeline does not comprise a pipeline section inline thereof in which the first valve arrangement in installed. Rather, the first valve arrangement is simply installed in the first pipeline. Similarly, the second pipeline may not comprise a pipeline section inline thereof in which the second valve arrangement is installed; rather, the second valve arrangement is simply installed in the second pipeline. It will however be appreciated that in this case, the valve arrangements would generally need to be installed in the pipelines on the laying vessel. It would be difficult to connect the valve arrangements with welding on a laying vessel, so bolted flange connections or hydraulic connectors would typically need to be used. The connections would then need to be tested on the vessel, e.g. pressure tested, which takes time. This involves expense by taking up more time on the laying vessel: use of a laying vessel is extremely expensive, so needing to carrying out testing procedures on a vessel would involve considerable cost in terms of ship-hours. Therefore, it is desirable to make the procedure on the vessel as simple as possible.

Consequently, it is preferred to utilise pipeline sections in which the valve arrangements can be installed and tested on-shore, the pipeline sections then being connected inline of a pipeline. Another reason for preferring pipeline sections is that a welded connection between the valve arrangements and pipeline sections which is carried out and thoroughly tested onshore is likely to be more reliable than e.g. bolted flange connections carried out on a vessel. The latter may introduce more potential leakage points.

Where pipeline sections are referred to below, it is to be understood that these are or can be inline of pipelines. Where features of pipeline sections are described it will be appreciated that these may equally be features of pipelines. Conversely, where features of pipelines are described, it will be appreciated that these may equally be features of pipeline sections inline of pipelines.

The valve arrangements may alternatively be termed valve assemblies.

It will be appreciated that in the present invention, the valve arrangements provide the fluid flow routing function which would normally be provided by a cluster manifold in a traditional cluster manifold arrangement. In other words, normal manifold functionality is integrated into the pipeline by means of the valve arrangements, resulting in a much simpler arrangement requiring less hardware and which is therefore much simpler and cheaper to install than a cluster manifold. Therefore, it can be seen that in the most preferred embodiment of the invention, the subsea well installation does not comprise a cluster manifold.

The present invention thus provides the important advantage that no cluster manifold is required, thus avoiding the significant hardware cost of a cluster manifold, and the high installation cost of a cluster manifold. Furthermore, since no cluster manifold is used, no pipeline spools are required to connect the cluster manifold to the pipeline. Again, this results in significant cost savings both in terms of hardware and installation cost associated with the pipeline spools.

Since the installation of the invention is arranged such that fluid can be routed from the first well to any of the first pipeline and second pipeline, the invention provides flow-paths that enable flow to be routed as desired depending for example on the flow rate of fluids, e.g. hydrocarbons, in a pipeline. For example, if the first pipeline has a high flow rate and the second pipeline has a low flow rate it may be desired to route the flow from the first well into the second pipeline. Vice versa, if the first pipeline has a low flow rate and the second pipeline has a high flow rate then it may be desired to route the flow from the first well into the first pipeline. Thus, the flow provided in the two pipelines is balanced out. This is easily achieved in the installation of the invention.

Each valve arrangement (e.g. the first and/or second valve arrangement) may comprise three ports, having one port connected to a subsea well, a second port connected to a pipeline and a third port connected to another valve arrangement. The valve arrangements may each be arranged to allow selective routing of fluid between the three ports. For example, fluid maybe routed from the first port to the second or third port and fluid may be routed from the third port to the second port and from the second port to the third port.

The first valve arrangement may have a first port connected to a first subsea well, a second port connected to the first pipeline and a third port connected to the second valve arrangement. The second valve arrangement may have a first port connected to a second subsea well, a second port connected to the second pipeline and a third port connected to the first valve arrangement.

The three ports of each valve arrangement may be the first ports of three two-way valves, with the second ports of each two-way valve connected to a space that is between the ports. Alternatively the three ports may be ports of a three-way valve.

Each valve arrangement may comprise three valves (e.g. one associated with each port). One or more or all of these may be two way valves. Each valve arrangement may comprise a three way valve.

Each valve arrangement may be arranged so that fluid from the subsea well may be selectively directed from the first port to the second or third port, and this may be achieved either by three two-way valves or one three-way valve.

In one preferred embodiment the first valve arrangement comprises three two-way valves. These may be first, second and third valves, each having two ports. The first two-way valve may have a first port connected to the first subsea well and a second port connected to a space communicating between second ports of the first, second and third two-way valves. The second two-way valve may have a first port connected to a first pipeline and a second port connected to the space communicating between second ports of the first, second and third two-way valves. The third two-way valve may have a first port connected to the second valve arrangement and a second port connected to the space communicating between second ports of the first, second and third two-way valves.

Therefore, for example, by operation of the first two-way valve, fluid can be routed from the first subsea well into the space communicating between the second ports of the first, second and third two-way valves. By operation of the second two-way valve the fluid can be routed to the first pipeline. Or, by operation of the third two-way valve the fluid can be routed to the second valve arrangement. The second valve arrangement may route the flow to the second pipeline.

Similarly, the second valve arrangement may comprise three two-way valves. These may be fourth, fifth and sixth valves, each having two ports. The fourth two-way valve may have a first port connected to the second subsea well and a second port connected to a space communicating between second ports of the fourth, fifth and sixth two-way valves. The fifth two-way valve may have a first port connected to a second pipeline and a second port connected to the space communicating between second ports of the fourth, fifth and sixth two-way valves. The sixth two-way valve may have a first port connected to the first valve arrangement and a second port connected to the space communicating between second ports of the fourth, fifth and sixth two-way valves.

Therefore, for example, by operation of the fourth two-way valve, fluid can be routed from the second subsea well into the space communicating between the second ports of the fourth, fifth and sixth two-way valves. By operation of the fifth two-way valve the fluid can be routed to the second pipeline. Or, by operation of the sixth two-way valve the fluid can be routed to the first valve arrangement. The first valve arrangement may route the flow to the first pipeline.

Most preferably the first and/or second valve arrangements comprise three ball valves. In other words any or all of the first, second, third, fourth, fifth and sixth valves may each be a ball valve. The ball valves may for example be ROV operable or electrically actuatable. Thus, each ball valve may have an interface for connection to an ROV or an interface for connection to an electric actuator.

In another embodiment the first valve arrangement comprises a three way valve, having one port connected to the first subsea well, a second port connected to the first pipeline and a third port connected to the second valve arrangement. Thus, flow can be routed between any of these ports. Similarly, the second valve arrangement may comprise a three way valve, having one port connected to the second subsea well, a second port connected to the second pipeline and a third port connected to the first valve arrangement. However, such a solution comprising three-way valves may be less robust than using three two-way valves, e.g. three ball valves, as in the embodiment discussed above.

The first valve arrangement may be connected to the first subsea well with a first jumper. Preferably this is a flexible jumper. The first jumper may be piggy backed onto the first pipeline during installation. So, the first jumper may be connected at one end to the first valve arrangement topside, e.g. on a laying vessel prior to deployment. The first jumper may be fluidly connected to the first valve arrangement during deployment (i.e. the connection has already been made before the pipeline and valve arrangement is lowered subsea). Thus the jumper may be fluidly connected to the first pipeline (via the first valve arrangement) during deployment of the pipeline. The other end may be "free", i.e. unconnected. The jumper is then strapped to the pipeline, i.e. secured to the pipeline during installation. After the first pipeline has been installed subsea, the jumper may be released from the pipeline, e.g. an ROV can release the straps, and the free end of the jumper may be connected to the first subsea well. Therefore only one connection of the jumper may need to be made subsea. This is much simpler and less expensive than the well connections in existing cluster manifold arrangements, where the well jumpers between each well and the cluster manifold are rigid jumpers which need to be connected at both ends subsea.

Similarly, the second valve arrangement may be connected to the second subsea well with a second jumper. Again, preferably, this is a flexible jumper. The second jumper may be piggy backed onto the second pipeline during installation. So, the second jumper may be connected at one end to the second valve arrangement topside, e.g. on a laying vessel prior to deployment. The second jumper may be fluidly connected to the second valve arrangement during installation. The other end may be "free", i.e. unconnected. The jumper is then strapped to the pipeline, i.e. secured to the pipeline during installation. After the second pipeline has been installed subsea, the jumper may be released from the pipeline, e.g. an ROV can release the straps, and the free end of the jumper may be connected to the second subsea well. Therefore only one connection of the jumper may need to be made subsea. This is much simpler and less expensive than the well connections in existing cluster manifold arrangements, where the well jumpers between each well and the cluster manifold are rigid jumpers which need to be connected at both ends subsea.

So, in summary, in embodiments of the invention, the well jumpers are flexible and are connected to the valve arrangements topside prior to deployment. This reduces the installation cost of the well jumpers since less connections need to be made subsea. Moreover, the jumpers can then be connected up to the wells by ROV.

The first valve arrangement may be connected to the second valve arrangement with a third jumper. Preferably, this is a flexible jumper. This third jumper may be piggy backed onto either the first or the second pipeline during installation.

Not only is the subsea well installation arranged such that fluid can be routed from the first well to any of the first pipeline and second pipeline, but it can be further arranged such that fluid can be routed from the second well to any of the first pipeline and second pipeline.

To route fluid from the first well to the first pipeline it may go via the first valve arrangement (and not the second valve arrangement). To route fluid from the first well to the second pipeline it may go via the first valve arrangement and then second valve arrangement.

To route fluid from the second well to the first pipeline it may go via the second valve arrangement and then the first valve arrangement. To route fluid from the second well to the second pipeline it may go via the second valve arrangement (and not the first valve arrangement).

Specifically, to route fluid from the first subsea well to the first pipeline, the fluid may travel through a flexible jumper to the first two-way valve and enter the first valve arrangement. Flow may be directed within the first valve arrangement from the first two-way valve to the second two-way valve and enter the first pipeline.

In order to route fluid from the first subsea well to the second pipeline, the fluid may travel through a flexible jumper to the first two-way valve and enter the first valve arrangement. Flow may be directed within the first valve arrangement to the third two-way valve and travel from the first port of the third two-way valve through a flexible jumper to the first port of the sixth two-way valve to enter the second valve arrangement. From the second valve arrangement, the fluid may flow through the fifth two-way valve and into the second pipeline.

Alternatively, if there is a high flow rate in the first pipeline but a lower flow rate in the second, fluid may be routed from the first and second well into the same pipeline following the above flowpaths. A choke arrangement may be used to avoid backflow.

It will be understood that similar flowpaths may exist for each valve arrangement. In one embodiment, the first pipeline further comprises a third valve arrangement and the second pipeline further comprises a fourth valve arrangement. The third valve arrangement may be connected to a third subsea well, and the fourth valve arrangement connected to a fourth subsea well. The third valve arrangement may be connected to the fourth valve arrangement. The installation may be arranged such that fluid can be routed from the third well to any of the first pipeline and second pipeline. Furthermore, the installation may be arranged such that fluid can be routed from the fourth well to any of the first pipeline and second pipeline.

The third and fourth valve arrangements may have the same features as described above for the first and second valve arrangements, e.g. they may each comprise three ports and optionally two-way ball valves. Furthermore, they may be connected to the wells and each other with jumpers, preferably flexible jumpers, in the same way as described above for the first and second valve arrangements. Therefore, the details of this will not be repeated here.

In the case that the first pipeline comprises a first pipeline section as discussed above, the third valve arrangement may be installed in the first pipeline section or a third pipeline section that is also disposed inline of the first pipeline. Similarly in the case that the second pipeline comprises a second pipeline section as discussed above, the fourth valve arrangement may be installed in the second pipeline section or a fourth pipeline section that is also disposed inline of the second pipeline.

The valve arrangements will generally be located on the part of the pipeline (pipeline section) which is uppermost. The valve arrangements may each rest on and/or be supported by their respective pipeline.

Generally, the subsea well installation will further comprise a landing structure onto or into which the first and second pipelines are landed during the laying process. The landing structure will typically comprise a carrier supporting the first and second pipelines. The landing structure may comprise a support frame mounted on a suction anchor, with the carrier mounted to, e.g. on or in, the support frame.

The carrier may include two supports, one for each pipeline. The pipelines may be supported on or in the supports. The supports may each be a recess in the carrier. The supports may each comprise side portions and optionally a base portion.

In one embodiment the supports may be separate elements but are known together as a carrier, and are mounted directly to the support frame. In another embodiment the carrier further comprises a carrier base portion, to which the supports are mounted. Then, it is the carrier base portion which is mounted to the support frame.

In one preferred embodiment, the supports are curved supports, one configured to support part of the first pipeline, and one configured to support part of the second pipeline. The curved supports may be of a complementary shape to the pipelines. The supports may be of semi-circular tubular shape, curved in a similar fashion to the pipelines. They may each comprise a channel.

The carrier may also be termed a cradle; similarly, the supports may also be termed as cradles.

Each pipeline (or pipeline section) may be provided with two lever arms, one extending from each side, which are used to locate the pipeline in the support. The lever arms may comprise pins or shafts. The lever arms may be cylindrical, but in other embodiments may take other shapes. The lever arms may be fixed, e.g. welded, to the pipeline topside e.g. on the laying vessel. The two lever arms may be arranged opposite to each other around the circumference of the pipeline and extend laterally (e.g. radially) from the pipeline. It will be appreciated that in the case that each pipeline comprises a pipeline section as discussed above, the pipeline section may be provided with such lever arms.

Each support preferably has two openings, each arranged to receive a lever arm of the pipeline when the pipeline is laid into the support. Each opening may comprise a slot. The two openings may be complementary in shape to the two lever arms. The reception of the lever arms in the openings both locates and orientates each pipeline in the correct position in the support, and rotationally aligns the pipelines in terms of roll, pitch and yaw. This ensures that the valve arrangements are on the uppermost part of the pipeline as laid. The pipelines may be locked in place in the supports such that they are held in the correct position as described further below.

As mentioned above, each support may comprise side portions. One of the openings may be provided in each side portion. The side portions may be side panels. Each support may be of a complementary shape to the pipeline. For example, each support may be a semi-circular tubular shape, curved in a similar fashion to a pipeline. Each support may be in the form of a channel.

Each support may comprise two plates extending upwardly from a base of the carrier, one plate arranged on each side of the carrier so that the pipeline can be received therebetween. One of the openings may be provided in each plate. In one embodiment each opening is a slot with straight sides and a curved bottom.

Each plate also preferably comprises two guiding faces arranged at the top thereof, on either side of the opening. The guiding faces may each be triangularly shaped, with a straight edge extending at an angle from the top of a straight side of the slot to an apex. Thus, an obtuse angle may be formed between the straight side of the slot and the edge of the guiding face. The obtuse angle is preferably at least 225° or more.

This angled edge of each guiding face acts as a guiding system for the lever arm of the pipeline. As the pipeline is lowered into the support, the angled edges "catch" the lever arms and guide them down into the slot.

Furthermore, the guiding faces preferably bend outwards. These angled guiding faces act as a guiding system for the pipeline. As the pipeline is laid into the support, the guiding faces can "catch" the pipeline once it comes near the support, and guide it into and towards the bottom of the support.

A locking mechanism may be provided for locking a pipeline to the support in which it is laid. For example, such a locking mechanism may comprise a locking wedge configured to slide across each opening to thereby lock a lever arm received therein to the curved support. The wedges may be slid across each opening by means of a screw mechanism. Preferably each locking wedge is shaped so as to force each lever arm to the bottom of the opening. The lever arms are positioned on the pipeline so that when they are held at the bottom of the openings, the pipeline is correctly rotationally aligned within the support/carrier. Thus, by forcing the lever arms to the bottom of the openings, the pipeline is correctly rotationally aligned in terms of roll, pitch and yaw. Rotational alignment is important so that the valve arrangements in the pipeline are "upended", i.e. extends straight upwards, to enable easy connection with the wells and each other.

In one embodiment, the carrier is located and orientated on the support frame in the correct lateral and vertical position and orientation such that once the pipelines are laid in or on the supports they are correctly aligned and orientated. The carrier may be locked to the landing structure (fixedly attached) so that it cannot move relatively thereto. It is noted again here that, as mentioned above, the "carrier" may simply comprise two supports, together being termed a "carrier". In which case, these supports are directly locked to the landing structure. Or, it may comprise a carrier base to which two supports are mounted, in which case the base will generally be locked to the landing structure.

In another embodiment, the carrier may be located on the support frame in the correct vertical position and orientation, but be slidably mounted to the landing structure (e.g. the support frame of the landing structure) such that it may slide back and forth with respect to the landing structure (e.g. the support frame of the landing structure) to facilitate axial alignment of the pipelines supported by the supports. In this case the carrier may be termed a "sledge".

The carrier may be slidably received in or on a carrier holder. The carrier holder may comprise rails. The rails may be circular or square. There may be one or two rails, or three, or more. The rails may be below, next to or above (on each side of) the sledge. Therefore the sledge may be similar to a train car on rails. The sledge can have different geometries. It may be retrievable or non-retrievable.

Thus, once the pipelines have been laid in the carrier, the carrier can be slid in order to adjust the axial alignment of the pipelines. Once the correct axial alignment has been achieved, the carrier can be locked in position to the landing structure.

A locking mechanism may be provided which is configured to lock the carrier to the support frame or the carrier holder after axial alignment has been achieved. The carrier may preferably be powered to cause it to slide within the carrier holder. The carrier holder may alternatively be termed a carrier guide.

When the carrier is locked to the landing structure it cannot move relative to the landing structure. Consequently, the position of the valve arrangements in the pipelines may be fixed relative to each other and the wells and thus connection to each other and the wells can be achieved without risk of disconnection or damage due to relative movement therebetween which may occur should the pipelines not be locked in position.

In another embodiment, the supports of the carrier may be slidable with respect to each other and the landing structure so that each pipeline may be axially aligned with respect to the other pipeline.

Or, the subsea installation may comprise two carriers: one carrier comprising a support for receiving the first pipeline, the other carrier comprising a support for receiving the second pipeline. The carriers may be axially slidable with respect to each other so that the axial position of the carriers can be independently adjusted. Thus, the axial position of a pipeline supported by one carrier can be adjusted relative to the axial position of a pipeline supported by the other carrier.

It will be understood that where "locking" is referred to in relation to the carrier, this is intended to mean "fixedly attached", so that relative movement between the locked entities is prevented.

In one embodiment of the invention, the subsea installation further comprises: a carrier guide; and a carrier for receiving the first pipeline; wherein the carrier is slidably received in the carrier guide such that the carrier may slide with respect to the carrier guide; wherein the carrier comprises a support for supporting at least a portion of the first pipeline; such that the first pipeline supported by the support may be slid with respect to the carrier guide.

The carrier is therefore slidable back and forth to facilitate axial alignment of the first pipeline supported thereby. A locking mechanism may be provided which is configured to lock the carrier to the carrier guide after axial alignment has been achieved. The carrier may preferably be powered to cause it to slide within the carrier guide. The carrier guide will generally be locked to a landing structure on which it is mounted.

The subsea well installation may further comprise a second carrier guide and a second carrier slidably received in the second carrier guide such that the second carrier may slide with respect to the second carrier guide. The second carrier may comprise a support for supporting at least a portion of a second pipeline. The carriers may be slidable relative to each other such that the first pipeline and second pipeline supported thereby are slidable relative to each other.

The ability to adjust the axial alignment of the pipelines with respect to each other may be useful to correctly position the valve arrangements of one of the pipelines in relation to the valve arrangements of the other pipeline, to facilitate connection therebetween.

Moreover, it is generally important for the pipelines to be correctly positioned, so that the valve arrangements can be connected up to each other and to the wells by the jumpers. If the pipelines were not correctly positioned, then for example the jumpers may not reach the wells to which they are to be connected. As discussed previously, in traditional cluster manifold arrangements, the cluster manifold is installed and spools or jumpers are then manufactured to the correct length for connecting the manifold to each well. This process typically takes five to seven weeks, thus delaying commencement of production from the wells. In embodiments of the invention, since no cluster manifold is required (as manifold functionality may be achieved with the first and second valve arrangements) and flexible well jumpers are piggy backed to the pipelines during installation, no separate well jumper installation step is required. Moreover, the jumpers can be connected up by ROV typically in a single operation. Thus, installation is relatively much quicker and simpler than in the prior art, and it is possible to start up production immediately.

The invention further extends to a method of operating a subsea well installation as described above. The method may comprise receiving fluid from the first well at the first valve arrangement and routing the fluid from the first valve arrangement to either the first pipeline or the second valve arrangement; and wherein if fluid is routed to the second valve arrangement the method may further comprise routing the fluid from the second valve arrangement to the second pipeline.

The method may comprise receiving fluid from the second well at the second valve arrangement and routing the fluid from the second valve arrangement to either the second pipeline or the first valve arrangement; and wherein if fluid is routed to the first valve arrangement the method may further comprise routing the fluid from the first valve arrangement to the first pipeline.

In a third aspect, the present invention provides a method of installing a subsea well installation, the method comprising deploying a first pipeline comprising a first valve arrangement, deploying a second pipeline comprising a second valve arrangement, connecting the first valve arrangement to the first subsea well, connecting the second valve arrangement to a second subsea well, and connecting the first valve arrangement to the second valve arrangement, wherein the installation is arranged such that fluid can be routed from the first well to any of the first pipeline and second pipeline.

The subsea well installation may be as described above.

Owing to the fact that the first pipeline comprises the first valve arrangement the step of deploying the first pipeline results in also deploying the first valve arrangement. In other words, the pipeline and valve arrangement may be installed together. This may be because the first valve arrangement is attached to, mounted on and/or integral with the first pipeline.

The method may comprise installing the first valve arrangement into a first pipeline topside (i.e. such that the first pipeline comprises the first valve arrangement), and subsequently deploying the first pipeline with the first valve arrangement integrated therein.

The method may comprise installing the first valve arrangement into a first pipeline section topside, e.g. on-shore, and subsequently deploying the first pipeline section, with the first valve arrangement integrated therein, inline of the first pipeline.

Similarly, the method may comprise installing the second valve arrangement into a second pipelinetopside, and subsequently deploying the second pipeline with the second valve arrangement integrated therein.

The method may comprise installing the second valve arrangement into a second pipeline section topside, e.g. on-shore, and subsequently deploying the second pipeline section, with the second valve arrangement integrated therein, inline of the first pipeline.

In this way the first valve arrangement and second valve arrangement may be fluidly connected to the first pipeline (e.g. via a first pipeline section) and second pipeline (e.g. via a second pipeline section) respectively, before deployment. This means that the valve arrangements do not require connecting to the respective pipelines subsea.

The method may typically comprise deploying (i.e. installing) the first valve arrangement inline of (i.e. integral therewith) the first pipeline and deploying (i.e. installing) the second valve arrangement inline of (i.e. integral therewith) the second pipeline prior to deployment of the first and second pipelines.

Deploying the first and second valve arrangements inline of the first and second pipelines respectively may comprise installing the first and second valve arrangements directly in/on the first and second pipelines. This may be done on the laying vessel top-side.

However, more preferably, deploying the first and second valve arrangements in the first and second pipelines respectively comprises installing the first and second valve arrangements in the first and second pipeline sections. Preferably this is done on-shore and not on the laying vessel. Then, the first and second pipeline sections are connected inline of the first and second pipelines respectively such that the pipelines comprise the pipeline sections. This is preferably done on the laying vessel prior to deployment of the pipelines subsea. Thus, the valve arrangements are installed in/on the pipeline sections, and the pipeline sections are connected inline of the pipelines, hence the valve arrangements are deployed inline of the pipelines.

The valve arrangements may be as described above in relation to the subsea well installation, e.g. having three ports with capability to route fluid selectively between the ports.

Preferably, the first valve arrangement comprises three two-way valves: first second and third valves, each having two ports. The first two-way valve may have a first port connected to the first subsea well and a second port connected to a space communicating between second ports of the first, second and third two-way valves. Thus the step of connecting the first valve arrangement to the first subsea well will typically comprise connecting the first port of the first two-way valve to the first subsea well, preferably by means of a jumper (as will be discussed further below).

The second two-way valve may have a first port connected to a first pipeline and a second port connected to the space communicating between second ports of the first, second and third two-way valves.

The third two-way valve may have a first port connected to the second valve arrangement and a second port connected to the space communicating between second ports of the first, second and third two-way valves. Thus the step of connecting the first valve arrangement to the second valve arrangement will typically comprise connecting the first port of the third two-way valve of the first valve arrangement to the second valve arrangement, preferably by means of a jumper (as will be discussed further below).

Therefore, for example, by operation of the first two-way valve, fluid can be routed from the first subsea well into the space communicating between the second ports of the first, second and third two-way valves. By operation of the second two-way valve the fluid can be routed to the first pipeline. Or, by operation of the third two-way valve the fluid can be routed to the second valve arrangement. The second valve arrangement may route the flow to the second pipeline.

Most preferably the first and/or second valve arrangements comprise three ball valves. In other words the first, second and third valves may each be a ball valve. The three ball valves may for example be ROV operated or electrically actuatable. Thus, each ball valve may have an interface for connection to an ROV or an interface for connection to an electric actuator.

The step of connecting the first valve arrangement to the first subsea well and/or the step of connecting the second valve arrangement to the second subsea well is preferably carried out by ROV.

The step of connecting the first valve arrangement to the first subsea well preferably comprises connecting the first valve arrangement and first subsea well with a jumper, most preferably a flexible jumper. The jumper may be fluidly connected to the first valve arrangement during deployment of the first pipeline. The jumper may be piggybacked to the first pipeline (which includes being piggybacked to a first pipeline section installed inline of the first pipeline) during deployment of the first pipeline. Being piggybacked to the first pipeline may comprise being secured, e.g. strapped, to the first pipeline e.g. with straps. The method may comprise fluidly connecting the jumper to the first valve arrangement prior to deployment of the first pipeline. The method may comprise the step of strapping the jumper to the first pipeline prior to deployment of the first pipeline, most preferably on the laying vessel. The method may then further comprise the step of cutting the straps that strap the jumper to the first pipeline in order to release the jumper, prior to the step of connecting the first valve arrangement to the first subsea well. The step of cutting the straps is preferably carried out by ROV.

Most preferably, the jumper is connected to the first valve arrangement prior to deployment of the first pipeline, e.g. top side such as on the laying vessel. Then, the free end of the jumper (which may be for connection to the first well) may be piggybacked to the first pipeline. So, during the subsequent process of connecting the first valve arrangement to the subsea well, no connection needs to be made subsea between the jumper and the first valve arrangement since this connection has already been carried out. The only connection that needs to be made is between the free end of the jumper and the first well. This is most preferably carried out by ROV. Since the connection between the jumper and the valve arrangement has been carried out topside e.g. on the laying vessel and thus only the connection between the free end of the jumper and the well needs to be carried out subsea, this simplifies the installation process, saving time and costs.

Similarly, the step of connecting the second valve arrangement to the second subsea well preferably comprises connecting the second valve arrangement and second subsea well with a jumper, most preferably a flexible jumper. The jumper may be fluidly connected to the second valve arrangement during deployment of the first pipeline. The jumper is preferably piggybacked to the second pipeline (which includes being piggybacked to a second pipeline section installed inline of the second pipeline) during deployment of the second pipeline. Being piggybacked to the second pipeline will typically comprise being secured, e.g. strapped, to the second pipeline e.g. with straps. The method may comprise fluidly connecting the jumper to the second valve arrangement prior to deployment of the first pipeline. The method may therefore preferably comprise the step of securing, e.g. strapping, the jumper to the second pipeline prior to deployment of the second pipeline, most preferably on the laying vessel. The method may then further comprise the step of cutting the straps that secure, e.g. strap, the jumper to the second pipeline in order to release the jumper, prior to the step of connecting the second valve arrangement to the second subsea well. The step of cutting the straps is preferably carried out by ROV.

Most preferably, the jumper is connected to the second valve arrangement prior to deployment of the second pipeline, e.g. on the laying vessel. Then, the free end of the jumper is piggybacked to the second pipeline. So, during the subsequent process of connecting the second valve arrangement to the subsea well, no connection needs to be made subsea between the jumper and the second valve arrangement since this connection has already been carried out. The only connection that needs to be made is between the free end of the jumper and the second well. This is most preferably carried out by ROV. Since the connection between the jumper and the valve arrangement has been carried out topside e.g. on the laying vessel and thus only the connection between the free end of the jumper and the well needs to be carried out subsea, this simplifies the installation process, saving time and costs.

The first valve arrangement is preferably connected to the second valve arrangement with a jumper, most preferably a flexible jumper. This jumper may be fluidly connected to the first or second valve arrangement prior to deployment, i.e. connected topside. The jumper is preferably piggybacked to the first pipeline or second pipeline (which includes being piggybacked to a first or second pipeline section installed inline of the first or second pipeline) during deployment of the first or second pipeline. The jumper may be piggy backed onto the pipeline that comprises the valve arrangement to which the jumper is fluidly connected topside. Being piggybacked to the first or second pipeline will typically comprise being connected, e.g. strapped, to the first or second pipeline, e.g. with straps. The method may therefore preferably comprise the step of strapping the jumper to the first or second pipeline prior to deployment of the first or second pipeline, most preferably on the laying vessel. The method may then further comprise the step of, after deployment subsea, cutting the straps that strap the jumper to the first or second pipeline in order to release the jumper, prior to the step of connecting the first valve arrangement to the second valve arrangement. The step of cutting the straps is preferably carried out by a ROV.

Most preferably, if the jumper is piggybacked to the first pipeline, the jumper is connected to the first valve arrangement prior to deployment of the first pipeline, e.g. topside such as on the laying vessel. Then, the free end of the jumper is piggybacked to the first pipeline. So, during the subsequent process of connecting the first valve arrangement to the second valve arrangement, no connection needs to be made subsea between the jumper and the first valve arrangement since this connection has already been carried out. The only connection that needs to be made is between the free end of the jumper and the second valve arrangement. This is most preferably carried out by ROV. Since the connection between the jumper and the valve arrangement has been carried out topside e.g. on the laying vessel and thus only the connection between the free end of the jumper and the other valve arrangement needs to be carried out subsea, this simplifies the installation process, saving time and costs.

Similarly, if the jumper is piggybacked to the second pipeline, the jumper is most preferably connected to the second valve arrangement prior to deployment of the second pipeline, e.g. on the laying vessel. Then, the free end of the jumper is piggybacked to the second pipeline. So, during the subsequent process of connecting the first valve arrangement to the second valve arrangement, no connection needs to be made subsea between the jumper and the first second arrangement since this connection has already been carried out. The only connection that needs to be made is between the free end of the jumper and the first valve arrangement. This is most preferably carried out by a ROV. Since the connection between the jumper and the valve arrangement has been carried out topside e.g. on the laying vessel and thus only the connection between the free end of the jumper and the other valve arrangement needs to be carried out subsea, this simplifies the installation process, saving time and costs.

The method may comprise deploying, i.e. installing, the first pipeline together with the first valve arrangement, and optionally one or more jumpers connected to the valve arrangement, wherein the one or more jumpers may be piggy backed on the first pipeline. The method may comprise deploying, i.e. installing, the second pipeline together with the second valve arrangement, and optionally one or more jumpers connected to the valve arrangement, wherein the one or more jumpers may be piggy backed on the second pipeline.

The method may comprise connecting (e.g. connecting after deployment, i.e. subsea) the first valve arrangement to the first subsea well using a jumper that is connected to the first valve arrangement and may have been piggybacked on the pipeline during installation.

The method may comprise connecting (e.g. connecting after deployment, i.e. subsea) the second valve arrangement to the second subsea well using a jumper that is connected to the second valve arrangement and may have been piggybacked on the pipeline during installation.

The method may comprise connecting (e.g. connecting after deployment, i.e. subsea) the first valve arrangement to the second valve arrangement using a jumper that is connected to the first valve arrangement and may have been piggybacked on the first pipeline during installation.

In one embodiment, the first pipeline may comprise a third valve arrangement and the second pipeline may comprise a fourth valve arrangement. The method may include connecting the third arrangement to a third subsea well, connecting the fourth valve arrangement to a fourth subsea well and connecting the third valve arrangement to the fourth valve arrangement, such that fluid can be routed from the third well to any of the first pipeline and second pipeline. Preferably, fluid can also be routed from the fourth well to any of the first pipeline and second pipeline.

The third and fourth valve arrangements may be connected to the third and fourth wells and each other by jumpers, in the same way as described above for the first and second valve arrangements. The details of this will therefore not be repeated again here.

In one embodiment, the steps of deploying the first pipeline and the second pipelines comprise laying the pipelines into or onto a carrier at a landing structure such that the carrier supports the pipelines. The landing structure may comprise a support frame mounted on a suction anchor.

The carrier preferably comprises two supports, one for receiving each pipeline. In one embodiment it may comprise a base to which the supports are mounted.

Each pipeline may comprise two lever arms and each support may comprise two openings each for receiving a respective lever arm. Therefore, laying the pipelines into the carrier may comprise laying the pipelines into the supports and locating the lever arms in the openings of the supports. The lever arms may comprise pins or shaft. Each opening may comprise a slot. The lever arms may be arranged opposite to each other around the circumference of the pipeline and may extend laterally from the pipeline.

The method may further comprise locking the lever arms in the openings to thereby lock the pipelines to the supports and thereby the carrier. Locking may comprise sliding a locking wedge over the top of one or each lever arm to hold it in place in the opening.

The method may comprise rotationally aligning the header pipe joint by pushing the lever arms to the bottom of the opening.

The carrier may be slidably mounted to the landing structure such that it may slide with respect of the landing structure. Therefore, once the first and second pipelines are laid into the carrier, the method may comprise the step of sliding the carrier so as to axially align the first and second pipelines.

In another embodiment, the supports of the carrier may be slidable with respect to each other and the structure so that each pipeline may be axially aligned with respect to the other pipeline. Or, the subsea installation may comprise two carriers: one carrier comprising a support for receiving the first pipeline, the other carrier comprising a support for receiving the second pipeline. The carriers may be axially slidable relative to each other so that the axial position of the carriers can be independently adjusted. Thus, the axial position of a pipeline supported by one carrier can be adjusted relative to the axial position of a pipeline supported by the other carrier. Therefore the method may comprise laying the pipelines into or onto the supports and then sliding the supports with respect to each other so as to axially adjust the position of the pipelines.

Preferably, the carrier(s) receives power to cause it to slide in the carrier support. After the axial position of pipelines are adjusted, the method may comprise locking the carrier(s) to the landing structure.

It will be appreciated that other features of the carrier and supports described above in relation to the first aspect are equally applicable to the method of the invention so will not be described again here.

The valve arrangements that are each part of one of the pipelines may allow fluid to be selectively routed from each well to one or other of the pipelines. Thus the valve arrangements may each provide manifold functionality. Thus the valve arrangements may be regarded as manifolds that are integrated with, and hence installable with, the pipelines.

The fact that the first pipeline and second pipeline each comprise a valve arrangement means that manifold functionality may be achieved without having to have a separate manifold.

Most preferably, the installation does not comprise a cluster manifold.

It will be appreciated that optional and preferred features described in relation to one aspect of the invention may equally be applicable to other aspect(s).

Preferred embodiments of the present invention will now be described by way of example only and with reference to the accompanying drawings, in which.

Figure 1:
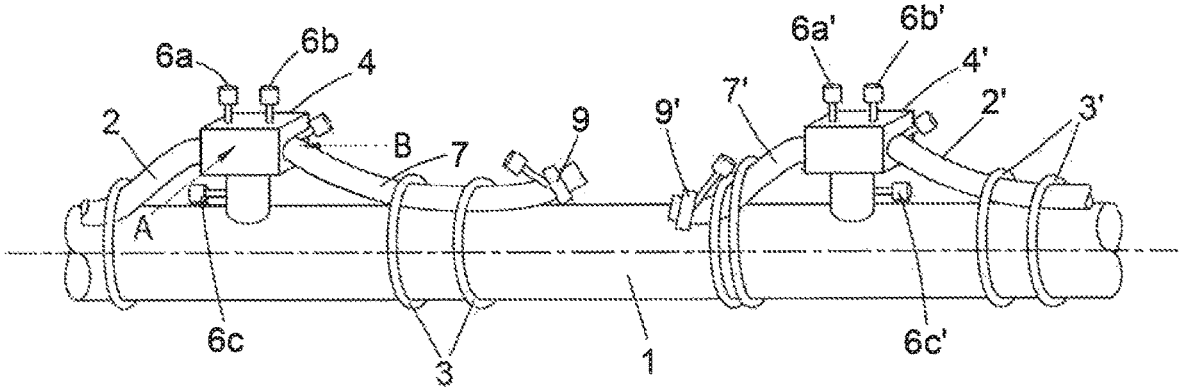
FIG. 1 illustrates a pipeline section having valves installed therein prior to installation, according to an embodiment of the invention.
Figure 3A:
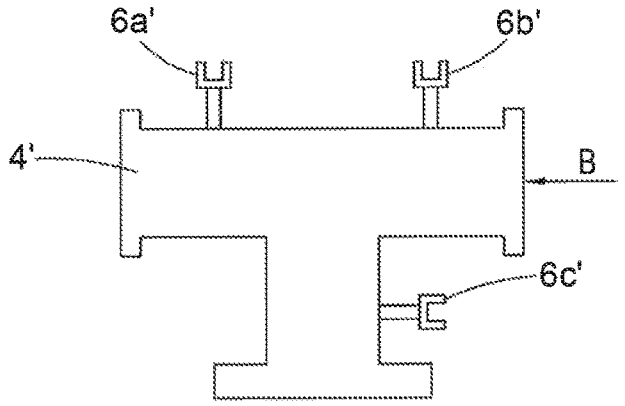
Figure 3B:
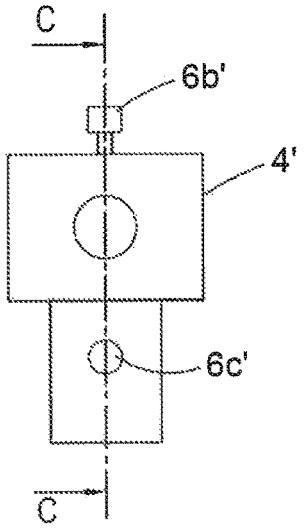
Figure 4:
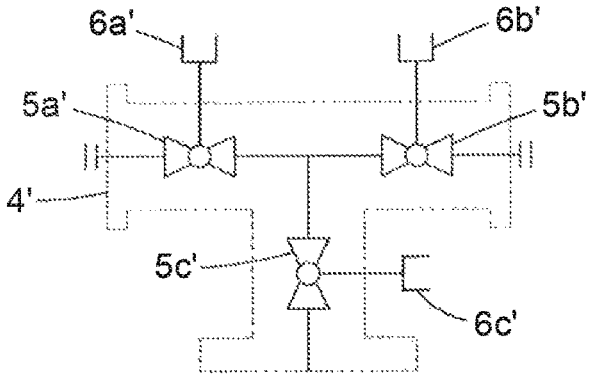

FIG. 3*a* is a side view of a valve viewed in the direction of arrow A in FIG. 1;

FIG. 3*b* is a side view of the valve of FIG. 3*a* viewed in the direction of arrow B of FIG. 1;

FIG. 4 is a schematic view of the valve of FIGS. 3*a* and 3*b;*

Figure 5:
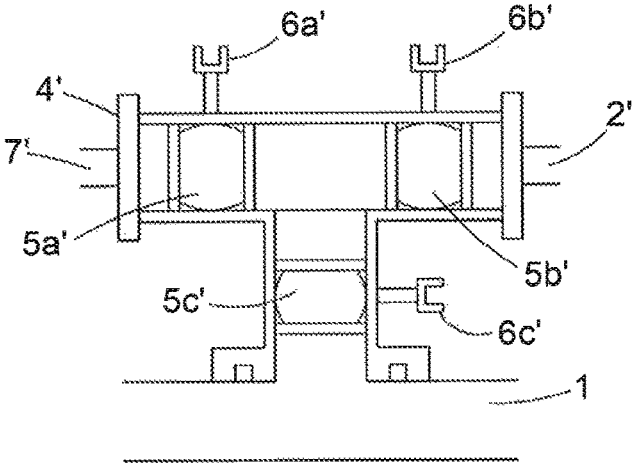

FIG. 5 is a cross-section of the valve taken along the line C-C of FIG. 3*b;*

Figure 2:
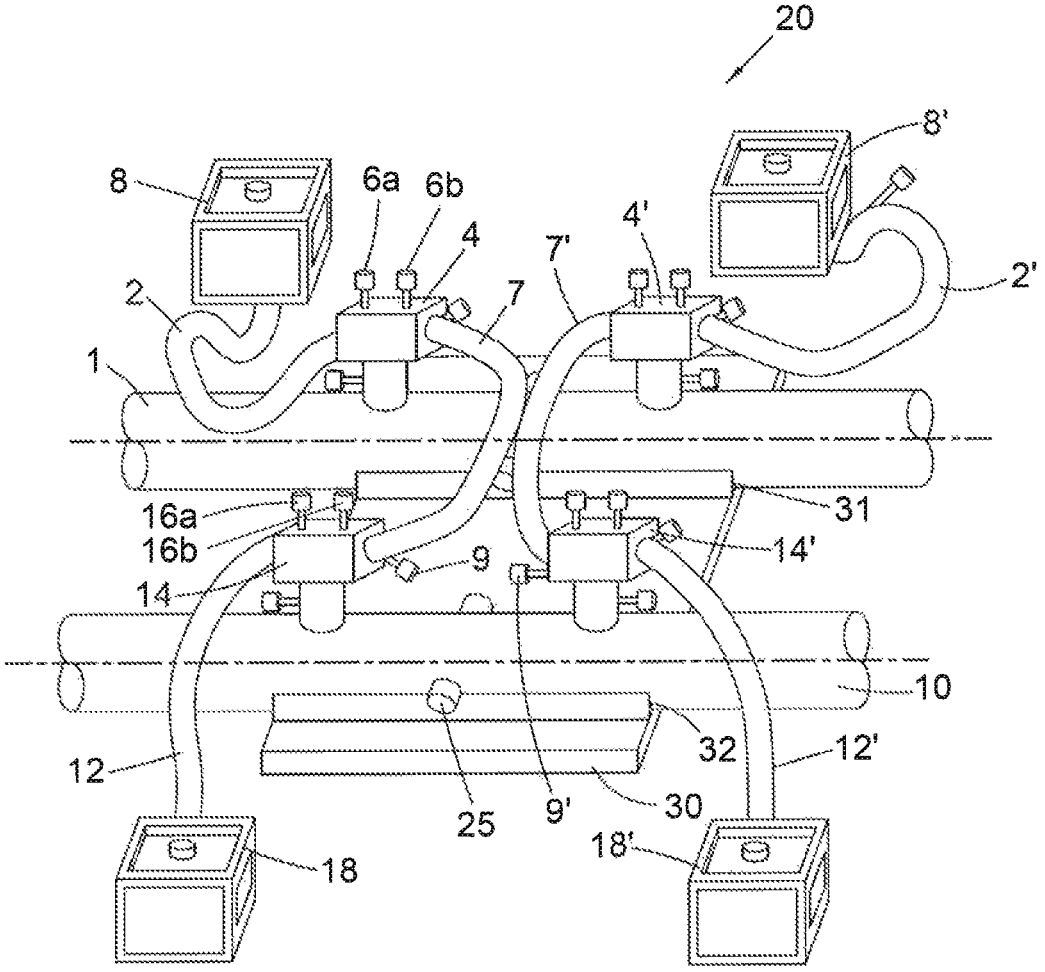
FIG. 2 illustrates a subsea well installation according to an embodiment of the invention.
Figure 6:
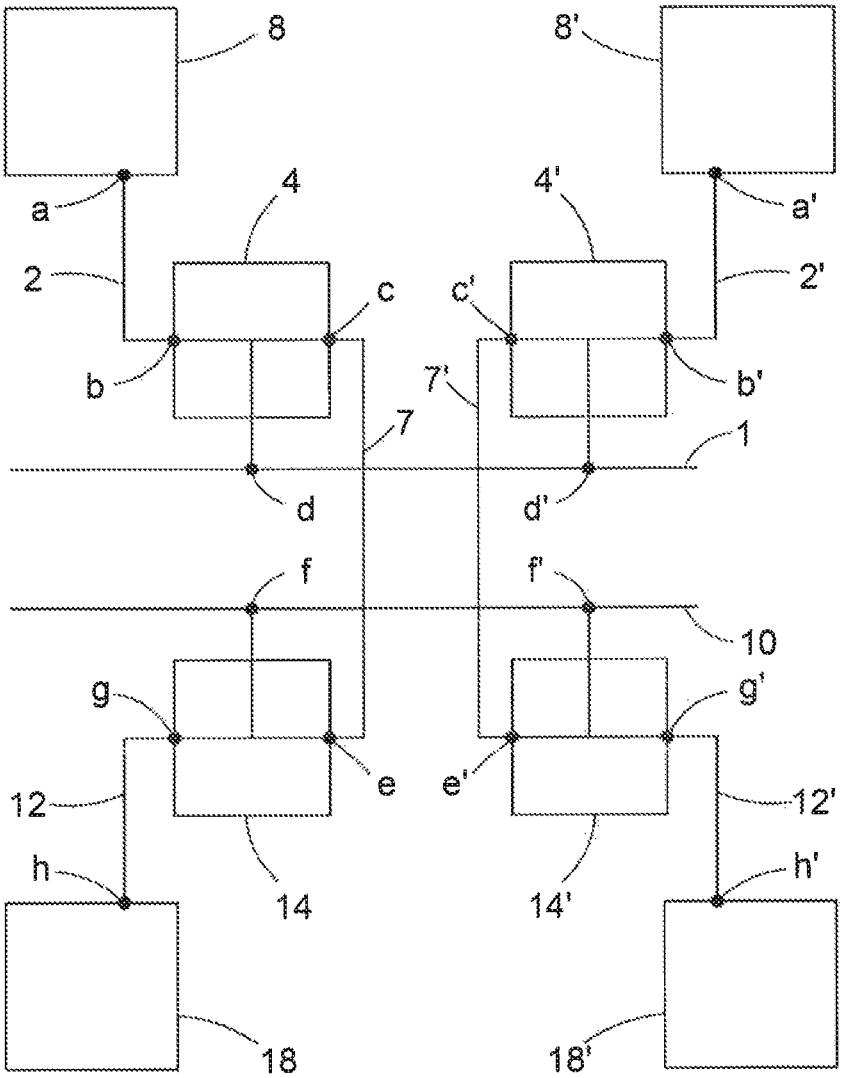
Figure 7:
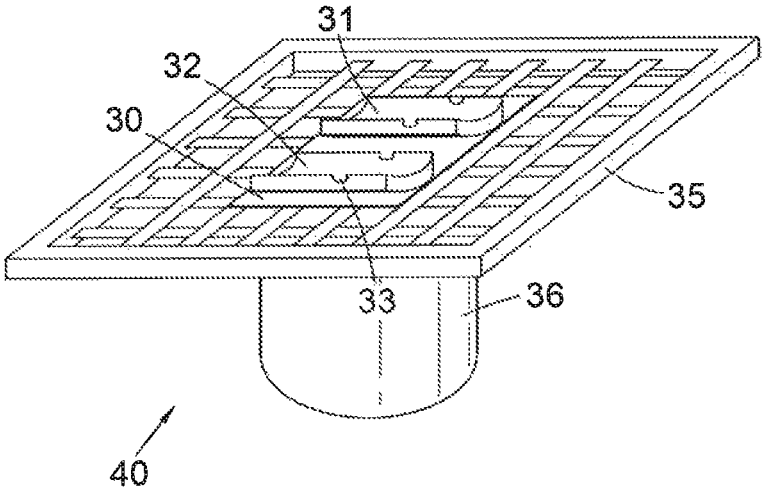
Figure 8:
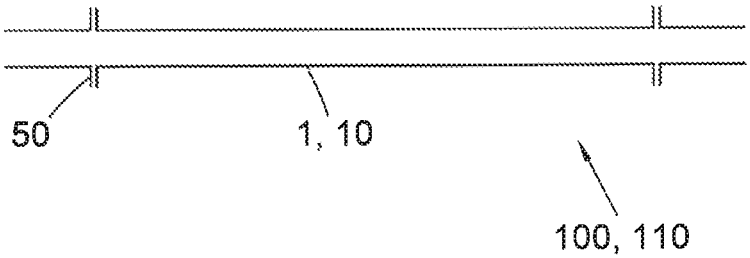
Figure 9A:
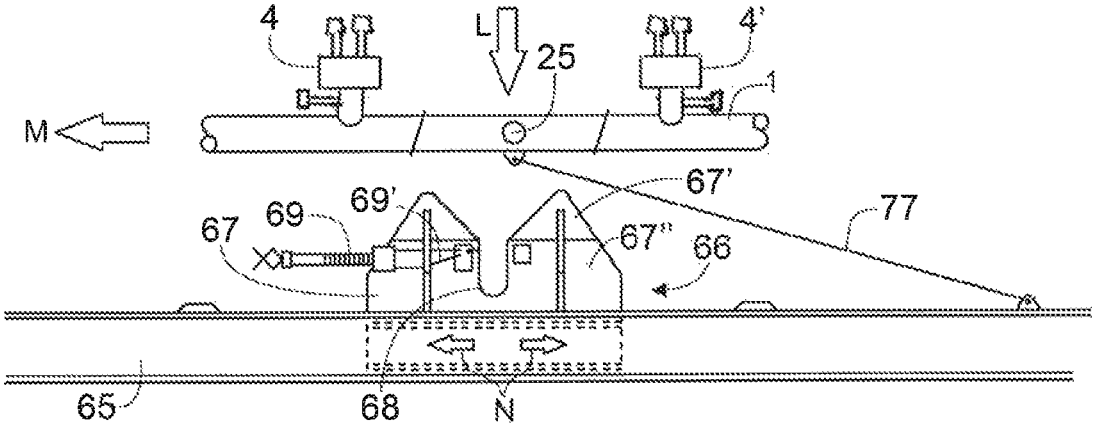
Figure 9B:
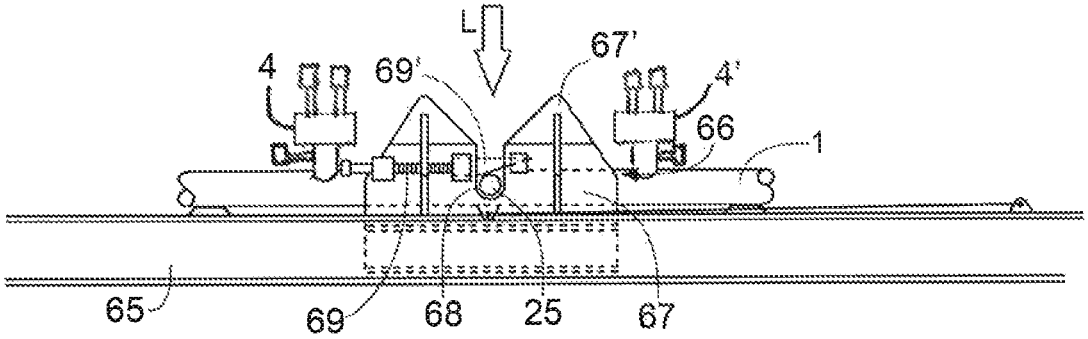

FIG. 6 schematically illustrates flow paths in the subsea well installation of FIG. 2;

FIG. 7 illustrates a foundation structure which may form part of the subsea well installation of FIG. 2;

FIG. 8 illustrates a pipeline having a pipeline section connected inline thereof and FIGS. 9A and 9B illustrate an embodiment of a carrier.

A pipeline section 1 is illustrated in FIG. 1. This section of pipeline 1 is typically 40 to 50 m long and is a section that is connectable inline of a complete pipeline. It may be termed a header pipe or header pipe joint. The pipeline section 1 will typically be connected inline of a complete pipeline prior to deployment subsea. A pipeline 100 having pipeline section 1 connected inline thereof by connectors 50 is illustrated in FIG. 8. Note that none of the features of pipeline section 1 are illustrated, this drawing merely shows the connection of the pipeline section 1 inline of the pipeline. The drawing can also be said to show the connection of a pipeline section 10 inline of a pipeline 110; pipeline section 10 is described later below.

The pipeline section 1 is shown in its pre-installed configuration, i.e. the configuration which it is in prior to and during deployment to the sea bed. Two valve arrangements (valve assemblies) 4, 4' are installed in (i.e. integrated into and/or supported by) the pipeline section 1 on the uppermost side of the pipeline section 1. Each valve arrangement is a three ball-valve arrangement, i.e. comprising three ball-valves, which will be described in more detail later with reference to FIGS. 3*a*, 3*b*, 4 and 5. Each ball valve 5*a*, 5*b*, 5*c* of the first valve arrangement 4 and each ball valve 5*a*', 5*b*' 5*c*' of the second valve arrangement 4' has an actuation interface 6*a*, 6*b*, 6*c*, 6*a*', 6*b*', 6*c*' respectively, by which the ball valve is actuated (controlled, operated). The ball valves may be actuated in different ways depending on the particular scenario. In one embodiment the actuation interfaces may be interfaces for ROV actuation. In another embodiment the actuation interfaces may be interfaces for electric actuators. ROV actuation may, in some situations, be simpler and cheaper than electric actuation. However, if the ball valves may need to be actuated relatively frequently, it may be less expensive to use electric actuators and install the necessary power supply rather than repeated uses of ROVs.

Two flexible jumpers 2, 7 and 2', 7' are connected to each valve arrangement 4, 4' respectively. Flexible jumper 2, 2' is configured for connecting to an xmas tree at a well. Flexible jumper 7, 7' is configured for connecting to another valve arrangement installed in another pipeline. Each flexible jumper 7, 7' comprises an ROV installable connector 9, 9' at an end thereof so that an ROV can connect the jumper 7, 7' to the other valve arrangement.

The valve arrangements 4, 4' will typically be fabricated, welded into the pipeline section 1 and then tested on-shore. The flexible jumpers 2, 7 and 2', 7' will be connected to the valve arrangements 4, 4' and are then strapped to the pipeline section 1 by straps 3, also on-shore. This is known as piggy-backing. Thus, the connections between the valve arrangements and the jumpers are already complete before a pipeline comprising the pipeline section is deployed subsea, hence avoiding the need to carry out these connections subsea, and thus minimising cost.

The preassembled pipeline section 1 comprising the valve arrangements and piggybacked jumpers is then supplied to the laying vessel, and connected (e.g. by welding) inline of a pipeline 100 topside on the vessel prior to laying of the pipeline 100 subsea. Hence, the pipeline section 1 becomes part of the pipeline 100. A laying operation is then performed to lay the pipeline, having the pipeline section 1 installed therein, at a landing structure at the seabed. An embodiment of a landing structure 40 is illustrated in FIG. 7. This comprises a foundation comprising a suction anchor 36 on which is mounted a support frame 35. A carrier 30 is mounted on the support frame, and has two curved supports 31, 32, each for holding and supporting a pipeline. This will be described in more detail later.

FIG. 2 illustrates a subsea well installation comprising a first pipeline having the pipeline section 1 inline thereof. The first pipeline has been laid into a curved support 31 of the carrier 30, mounted on the support frame of the support structure (not shown in FIG. 2). The installation also comprises a second pipeline having a second pipeline section 10 inline thereof which is substantially identical to the pipeline section 1 (although jumpers for connecting the valve arrangements of the second pipeline to the valve arrangements of the first pipeline may not be present on the second pipeline as the jumpers for connecting the valve arrangements are provided on the first pipeline), and which has been laid into a curved support 32 of the carrier 30. FIG. 2 illustrates the installation when the valve arrangements 4, 4' of the pipeline section 1, and the valve arrangements 14, 14' of the pipeline section 10, have been fully connected up. The connection process will now be described.

After the pipeline section 1 and the pipeline section 10 have been laid into the supports 31, 32 of the carrier 30, an ROV cuts the straps 3 which were strapping the flexible jumpers 2, 2' and 7, 7' to the pipeline section 1. Similar straps are also cut which were strapping the flexible jumpers 12, 12' to the pipeline section 10.

An ROV connects the flexible jumper 2 to the xmas tree of a well 8. Similarly an ROV connects the flexible jumper 2' to the xmas tree of a well 8', connects the flexible jumper 12 to the xmas tree of a well 18, and connects the flexible jumper 12' to the xmas tree of a well 18'. It will be appreciated that the wells are shown as considerably smaller than they are in practice, for ease of illustration.

An ROV connects the connector 9 of the flexible jumper 7 of the valve arrangement 4 to the valve arrangement 14 of the pipeline section 10. It also connects the connector 9' of the flexible jumper 7' of the valve arrangement 4' to the valve arrangement 14' of the pipeline section 10. The valve arrangements 14 and 14' do not need their own flexible jumpers similar to flexible jumpers 7, 7' of the valve arrangements 4, 4'. In this way, the pipeline sections 1 and 10 are therefore not identical. The same ROV may perform all the connections in the same operation. Once the connections have all been made, well production can start.

The valve arrangement 4' will now be described in more detail with reference to FIGS. 3*a*, 3*b*, 4 and 5. It will be appreciated that the valve arrangements 4 is essentially the same as the valve arrangement 4', though the particular configuration of components and location of connections varies slightly. For example, the ROV interface 6*c* of the valve arrangement 4 is on the opposite side to where the ROV interface 6*c*' is located on the valve arrangement 4', for ease of access. The valve arrangement 4' is substantially the same as the valve arrangement 14', whilst the valve arrangement 4 is substantially the same as the valve arrangement 14. Therefore, to avoid repetition, only the valve arrangement 4' is described in detail as the same essential features and functions apply equally to the other valve arrangements.

FIG. 3*a* illustrates the side of the valve arrangement 4' viewed in the direction of arrow A of FIG. 1. The ROV interfaces 6*a*' and 6*b*' extend from the top of the valve arrangement 4', whilst the ROV interface 6*c*' extends from a side. FIG. 3*b* is a side view of the valve arrangement 4' viewed in the direction of arrow B of FIG. 1 and FIG. 3*a*.

FIG. 4 schematically illustrates the ball valve functionality of the valve arrangement 4'. A first ball valve 5*a*' providing a two-way valve functionality is controllable by ROV via actuation interface 6*a*'. A second ball valve 5*b*' providing a two-way valve functionality is controllable by ROV via actuation interface 6*b*'. A third ball valve 5*c*' providing a two-way valve functionality is controllable by ROV via actuation interface 6*c*'. The ball valves may for example be standard 5-6 inch (0.127 m-0.152 m) or 8-9 inch (0.203 m-0.229 m) ball valves.

FIG. 5 is a cross-sectional view taken along line C-C of FIG. 3*b*, and shows the internal components of the valve arrangement 4'. The valve arrangement comprises three ball valves, 5*a*', 5*b*' and 5*c*'. Fluid flow can enter and leave the valve arrangement 4' via flexible jumper 2', flexible jumper 7' and the pipeline section 1 (and therefore the pipeline 100). The ball valves can be individually electrically actuated by ROV via interfaces 6*a*', 6*b*' and 6*c*' so as to receive flow from and direct flow to any of the flexible jumper 2', flexible jumper 7' and pipeline section 1. For example, if it is desired for flow produced from well 8' to enter the pipeline 100, then ball valves 6*b*' and 6*c*' are actuated so as to allow entry of flow from flexible jumper 2' and direct the flow to the pipeline section 1. If it is desired for flow from the valve arrangement 14' to enter the pipeline 100, then ball valves 6*a*' and 6*c*' are actuated so as to allow entry of flow from flexible jumper 7' and direct the flow to the pipeline section 1.

FIG. 6 schematically illustrates the various flow paths provided in the subsea well installation in more detail. The letters a, b, c, d, e, f, g and h denote various flow entry and exit points in the arrangement comprising: valve arrangements 4 and 14, wells 8 and 18, and pipeline sections 1 and 10. The letters a', b', c', d', e', f', g' and h' denote the various flow entry and exit points in the arrangement comprising: valve arrangements 4' and 14', wells 8' and 18' and pipeline sections 1 and 10.

Considering first the arrangement comprising valve arrangement 4 and 14, wells 8 and 18 and pipeline sections 1 and 10; flow may exit the well 8 at point a, travel through flexible jumper 2 and enter valve arrangement 4 at point b. Flow may be directed within the valve arrangement 4 either to point d where it enters pipeline section 1, or to point c where it exits valve arrangement 4 and travels through flexible jumper 7 to point 3 where it enters valve arrangement 14. The flow may be directed within valve arrangement 14 to point f where it enters pipeline section 10.

If flow was routed to point g where it exits valve arrangement 14 and travels through flexible jumper 12 to point h, it could potentially enter well 18 causing back flow. Therefore, flow would generally not be routed in this way. Furthermore, well-known backflow prevention methods may be used, for example chokes at the xmas tree outlets which equalise the pressure from well 8 and well 18.

Conversely, flow may exit well 18 at point h, travel through flexible jumper 12 and enter valve arrangement 14 at point g. Flow may be directed within the valve arrangement 14 either to point f where it enters pipeline 10, or to point e where it exits the valve arrangement 14 and travels through flexible jumper 7 to point c where it enters valve arrangement 4. The flow may be directed within valve arrangement 4 to point d where it enters pipeline section 1. As described above, it would not be desirable to route flow to point b where it exits valve arrangement 4 and travels through flexible jumper 2 to point a as it could then cause backflow into well 8. A choke arrangement could be used to avoid backflow as discussed previously.

Similar flowpaths are provided by the second arrangement comprising valve arrangements 4' and 14', wells 8' and 18' and pipeline sections 1 and 10, and so these will not be described here.

The flowpaths provided by the subsea well installation 20 of the present invention thus enable flow to be routed as desired depending for example on the flow rate of fluid from the wells, e.g. hydrocarbons being produced. For example, if there is a high flow rate in pipeline 100 but a lower flow rate in pipeline 110, it may be desirable to route the flow from both wells 8 and 18 into pipeline 110 to even out the flow rate in the pipelines.

Generally, flow from one well will not be divided between two pipelines, the whole flow will be provided to one pipeline.

The landing structure 40 of FIG. 7 will now be described in more detail. As discussed above, the landing structure 40 comprises a suction anchor 36 on which is mounted a support frame 35 having a carrier 30. The carrier comprises two curved supports 31, 32, each for holding and supporting a pipeline section 1, 10 respectively. During the laying process, the pipeline sections 1, 10 are laid into the curved supports 31, 32, which are of a complementary shape to the pipeline sections. The carrier 30 is located and orientated on the support frame 35 in the correct lateral and vertical position and orientation such that once the pipeline sections are laid in the supports 31, 32 they are correctly aligned and orientated.

As can be seen in FIG. 2, each pipeline section 1, 10 is provided with two lever arms 25, one extending from each side, which are used to locate the pipeline in the support (the lever arms are not shown in FIG. 1). The lever arms 25 may alternatively be termed locking pins, locating pins or shafts. The lever arms 25 are illustrated as being cylindrical, but in other embodiments may take other shapes. The lever arms may be fixed, e.g. welded, to the pipeline section 1, 10 topside e.g. on the laying vessel. Each curved support 31, 32 has two openings 33, arranged to receive the lever arms 25 of the pipeline section 1, 10 when the pipeline is laid into the support. The reception of the lever arms 25 in the openings 33 both locates and orientates the pipeline sections 1, 10 in the correct position in the support, and rotationally aligns the pipeline sections 1, 10 in terms of roll, pitch and yaw. This ensures that the valve arrangements 4, 4', 14, 14' are on the uppermost part of the pipeline 1, 10, as laid. Once the pipelines are laid in the supports they are locked in place such that they are prevented from moving.

It is important for the pipelines to be correctly positioned, so that the valve arrangements 4, 4', 14, 14' can be connected up to each other and to the wells 8, 8', 18, 18' by the jumpers 7, 7', 2, 2', 12, 12'. If the pipelines were not correctly positioned, then for example the jumpers may not reach the wells to which they are to be connected (though since flexible jumpers are used, an element of flexibility is provided).

In another embodiment of the carrier 66 as illustrated in FIGS. 9A and 9B, the carrier 66 may be slidably held in a carrier holder 65 on the support frame, so that it can be slid back and forth with respect to the support frame. Thus, once the pipelines 100, 110 having pipeline sections 1, 10 have been laid in the carrier 66, the carrier 66 can be slid in order to adjust the axial alignment of the pipelines. Once the correct axial alignment has been achieved, the carrier 66 can be locked in position in the carrier holder 65. The ability to adjust the axial alignment of the pipelines may be useful to correctly position them with respect to the wells. This embodiment will now be discussed in further detail.

Note that FIGS. 9A and 9B do not show the jumpers and strapping, for simplicity. The carrier holder 65 has a carrier 66 slidably held therein. The carrier holder 65 is attached to a support frame of the landing structure (not shown in FIGS. 9A and 9B). The carrier 66 is slidable back and forth in the direction of arrows N. The carrier 66 is configured to receive the pipeline section 1 when the pipeline 100 is laid at the structure. FIG. 9A illustrates the pipeline section 1 approaching the carrier 66 during the laying process. Rigging 77 is attached between the carrier holder 65 and the pipeline section 1 to guide the pipeline section 1 into place, as it moves down and along in the direction of arrows L and M.

The pipeline section 1 is provided with two lever arms 25, one extending from each side, which are used to locate the pipeline section in the carrier 66. The lever arms 25 may alternatively be termed locking pins, locating pins or shafts. The lever arms 25 are illustrated as being cylindrical, but in other embodiments may take other shapes. The lever arms may be fixed, e.g. welded, to the pipeline section 1 topside, preferably onshore.

When the pipeline section 1 reaches the carrier 66, it is received and supported by a support 67 of the carrier. The support 67 comprises two plates extending upwardly from the base of the carrier 66, one plate arranged on each side of the carrier so that the pipeline section 1 can be received therebetween.

Each plate comprises a base portion 67" having an opening (slot, groove) 68 therein for receiving a lever arm 25 of the pipeline section 1. The opening in this embodiment is a slot with straight sides and a curved bottom. Each plate also comprises two guiding faces 67', each extending from the top of the base portion 67" on either side of the opening 68.

The guiding faces 67' are each triangularly shaped, with a straight edge extending at an angle from the top of a straight side of the slot to an apex. Thus, an obtuse angle is formed between the straight side of the slot and the edge of the guiding face 67'. The obtuse angle is preferably at least 225° or more.

This angled edge of the guiding faces 67' act as a guiding system for the lever arm 25 of the pipeline section 1. As the pipeline section is lowered into the support, the angled edges "catch" the lever arms 25 and guide them down into the slot.

Furthermore, the guiding faces 67' bend outwards from the base portion 67" of each plate. In other words, they are at an angle to the base portion from which they extend. These angled guiding faces 67' act as a guiding system for the pipeline section 1. As the pipeline section 1 is laid into the support 67, the guiding faces 67' can "catch" the pipeline section 1 once it comes near the support 67, and guide it into and towards the bottom of the support 67.

The reception of the lever arms 25 in the openings 68 locates the pipeline section 1 in the correct position in the support 67/carrier 66. Arm 69 has a wedge 69' which is then slid across the top of each opening which forces each lever arm 25 to the bottom of the opening 68. The lever arms are positioned on the pipeline section so that when they are held at the bottom of the openings 68, the pipeline section 1 is correctly rotationally aligned within the support 67/carrier 66. Thus, by forcing the lever arms 25 to the bottom of the openings 68, the pipeline section 1 is correctly rotationally aligned in terms of roll, pitch and yaw. Rotational alignment is important so that the valve arrangements in the pipeline section are "upended", i.e. extend straight upwards, so that the actuation interfaces 6*a*, 6*b*, 6*a*', 6*b*' are easily accessible and so that the jumpers 2, 2' are correctly positioned so as to be connected up to the wells.

The carrier 66 is located on the landing structure in the correct lateral and vertical position, and thus once the pipeline section 1 is laid in the carrier, it is correctly aligned in terms of sway and heave. Surge (i.e. axial alignment) is adjusted as described later by sliding the carrier.

The wedges 69' may be slid across each opening by means of a screw mechanism at arm 69. They may then be locked in place across the top of each opening 68, thus locking the pipeline section 1 in the correct position. This is illustrated in FIG. 9B.

The pipeline section 1 can then be adjusted to the correct axial position by sliding the carrier 66 in the direction of arrows N.

Once correct axial alignment has been achieved, the carrier 66 is locked in position in the carrier holder 65, for example by a locking device such as screws, lugs, wedges or similar. Thus, the pipeline section 1 (and thereby the pipeline 100 it is inline of) is locked in the carrier 66, which is locked to the carrier holder 65, which is in turn attached to the support frame mounted on the suction anchor.

In this embodiment, the carrier 66 is powered to cause it to slide within the carrier holder 65 and thus enable easy positioning of the carrier 66 and thus the pipeline section 1 held therein. The position of the carrier is controlled by hydraulic jacking cylinders operated by an ROV.

It will be readily appreciated by the skilled person that various features of the sliding carrier of FIGS. 9A and 9B may be useful with the non-sliding carrier of FIG. 7. Whilst these features will not all be repeated again here for the sake of brevity, one example would be that the two curved supports 31, 32 may be provided with arms having wedges to slide across the top of the openings 33 to force the lever arms 25 to the bottom of the openings 33 and lock the pipeline section 1 in place. In another embodiment, a separate carrier may be provided for each pipeline, each carrier being independently slidable with respect to the other (or a single carrier may be provided having independently slidable curved supports). Thus, the axial alignment of the pipelines can be independently adjusted with respect to each other by separately sliding the carriers (or the curved supports). Once the correct axial alignment has been achieved, the carriers can be locked in position.

The ability to adjust the axial alignment of the pipelines with respect to each other may be useful to correctly position the valve arrangements of one of the pipelines in relation to the valve arrangements of the other pipeline, to facilitate connection therebetween.

The invention claimed is:

1. A method of installing a subsea well installation, the method comprising:

deploying a first pipeline comprising a first valve arrangement;

deploying a second pipeline comprising a second valve arrangement;

connecting the first valve arrangement to a first subsea well;

connecting the second valve arrangement to a second subsea well; and connecting the first valve arrangement to the second valve arrangement, wherein the subsea well installation is arranged such that fluid can be routed from the first well to any of the first pipeline and second pipeline;

wherein the step of connecting the first valve arrangement to the first subsea well comprises connecting the first valve arrangement and the first subsea well with a first jumper, wherein the first jumper is piggybacked to the first pipeline during deployment of the first pipeline by means of straps, and wherein the method further comprises the step of cutting the straps in order to release the first jumper prior to the step of connecting the first valve arrangement to the first subsea well.

2. A method as claimed in claim 1, wherein deploying the first and second valve arrangements comprises installing the first and second valve arrangements in first and second pipeline sections respectively, wherein the method further comprises connecting the first and second pipeline sections inline of the first and second pipelines, respectively.

3. A method as claimed in claim 1, wherein the first valve arrangement comprises three two-way valves: first, second and third valves, each having two ports; wherein:

the first two-way valve has a first port connected to the first subsea well and a second port connected to a space communicating between second ports of the first, second and third two-way valves and wherein the step of connecting the first valve arrangement to the first subsea well comprises connecting the first port of the first two-way valve to the first subsea well;

the second two-way valve has a first port connected to the first pipeline and a second port connected to the space communicating between second ports of the first, second and third two-way valves; and the third two-way valve has a first port connected to the second valve arrangement and a second port connected to the space communicating between second ports of the first, second and third two-way valves and wherein the step of connecting the first valve arrangement to the second valve arrangement comprises connecting the first port of the third two-way valve of the first valve arrangement to the second valve arrangement.

4. A method as claimed claim 1, wherein the step of connecting the second valve arrangement to the second subsea well comprises connecting the second valve arrangement and the second subsea well with a second jumper, wherein the second jumper is piggybacked to the second pipeline during deployment of the second pipeline by means of straps, and wherein the method further comprises the step of cutting the straps in order to release the second jumper prior to the step of connecting the second valve arrangement to the second subsea well.

5. A method as claimed in claim 1, wherein the first pipeline comprises a third valve arrangement and the second pipeline comprises a fourth valve arrangement, and the method further includes connecting the third valve arrangement to a third subsea well, connecting the fourth valve arrangement to a fourth subsea well and connecting the third valve arrangement to the fourth valve arrangement, such that fluid can be routed from the third well to any of the first pipeline and the second pipeline.

6. A method as claimed in claim 1, wherein the steps of deploying the first pipeline and deploying the second pipeline comprise laying the pipelines into or onto a carrier at a landing structure such that the carrier supports the pipelines.

7. A method as claimed in claim 6, wherein the carrier is slidably mounted to the landing structure and the method comprises the step of sliding the carrier so as to axially align the first and second pipelines.

8. A method as claimed in claim 6, wherein each pipeline comprises two lever arms and the carrier comprises two supports, each support having two openings for receiving the lever arms of a pipeline; and the step of laying the pipelines into or onto the carrier comprises laying the pipelines into or onto the supports and locating the lever arms in the openings of the supports.

9. A method as claimed in claim 1, wherein the installation is arranged such that fluid can be routed from the first well to the first pipeline via the first valve arrangement and to the second pipeline via the first valve arrangement and the second valve arrangement.

10. A method of installing a subsea well installation, the method comprising:

deploying a first pipeline comprising a first valve arrangement;

deploying a second pipeline comprising a second valve arrangement;

connecting the first valve arrangement to a first subsea well;

connecting the second valve arrangement to a second subsea well; and connecting the first valve arrangement to the second valve arrangement, wherein the subsea well installation is arranged such that fluid can be routed from the first well to any of the first pipeline and second pipeline;

wherein the step of connecting the second valve arrangement to the second subsea well comprises connecting the second valve arrangement and the second subsea well with a jumper, wherein the jumper is piggybacked to the second pipeline during deployment of the second pipeline by means of straps, and wherein the method further comprises the step of cutting the straps in order to release the jumper prior to the step of connecting the second valve arrangement to the second subsea well.

11. A method as claimed in claim 10, wherein deploying the first and second valve arrangements comprises installing the first and second valve arrangements in first and second pipeline sections respectively, wherein the method further comprises connecting the first and second pipeline sections inline of the first and second pipelines, respectively.

12. A method as claimed in claim 10, wherein the first valve arrangement comprises three two-way valves: first, second and third valves, each having two ports; wherein:

the first two-way valve has a first port connected to the first subsea well and a second port connected to a space communicating between second ports of the first, second and third two-way valves and wherein the step of connecting the first valve arrangement to the first subsea well comprises connecting the first port of the first two-way valve to the first subsea well;

the second two-way valve has a first port connected to the first pipeline and a second port connected to the space communicating between second ports of the first, second and third two-way valves; and the third two-way valve has a first port connected to the second valve arrangement and a second port connected to the space communicating between second ports of the first, second and third two-way valves and wherein the step of connecting the first valve arrangement to the second valve arrangement comprises connecting the first port of the third two-way valve of the first valve arrangement to the second valve arrangement.

13. A method as claimed in claim 10, wherein the first pipeline comprises a third valve arrangement and the second pipeline comprises a fourth valve arrangement, and the method further includes connecting the third valve arrangement to a third subsea well, connecting the fourth valve arrangement to a fourth subsea well and connecting the third valve arrangement to the fourth valve arrangement, such that fluid can be routed from the third well to any of the first pipeline and the second pipeline.

14. A method as claimed in claim 10, wherein the steps of deploying the first pipeline and deploying the second pipeline comprise laying the pipelines into or onto a carrier at a landing structure such that the carrier supports the pipelines.

15. A method as claimed in claim 14, wherein the carrier is slidably mounted to the landing structure and the method comprises the step of sliding the carrier so as to axially align the first and second pipelines.

16. A method as claimed in claim 14, wherein each pipeline comprises two lever arms and the carrier comprises two supports, each support having two openings for receiving the lever arms of a pipeline; and the step of laying the pipelines into or onto the carrier comprises laying the pipelines into or onto the supports and locating the lever arms in the openings of the supports.

17. A method as claimed in claim 10, wherein the installation is arranged such that fluid can be routed from the first well to the first pipeline via the first valve arrangement and to the second pipeline via the first valve arrangement and the second valve arrangement.

* * * * *